US012685916B2

(12) United States Patent
Chacon et al.

(10) Patent No.: US 12,685,916 B2
(45) Date of Patent: Jul. 21, 2026

(54) BASEBALL PLAYERS' RATING SYSTEM

(71) Applicants: Alain Chacon, Miami, FL (US); Serafin Dominguez, New York, NY (US)

(72) Inventors: Alain Chacon, Miami, FL (US); Serafin Dominguez, New York, NY (US)

( * ) Notice: Subject to any disclaimer, the term of this patent is extended or adjusted under 35 U.S.C. 154(b) by 249 days.

(21) Appl. No.: 18/316,292

(22) Filed: May 12, 2023

(65) Prior Publication Data

US 2023/0364487 A1 Nov. 16, 2023

Related U.S. Application Data

(60) Provisional application No. 63/341,146, filed on May 12, 2022.

(51) Int. Cl.

*A63B 71/06* (2006.01)
*A63B 24/00* (2006.01)
*A63B 102/18* (2015.01)

(52) U.S. Cl.

CPC ..... *A63B 71/0616* (2013.01); *A63B 24/0062* (2013.01); *A63B 71/0619* (2013.01); *A63B 2102/18* (2015.10)

(58) Field of Classification Search

CPC ..... A63B 71/0616; A63B 71/0619; A63B 24/0062; A63B 2102/18

See application file for complete search history.

(56) References Cited

U.S. PATENT DOCUMENTS

| | | | | |
|---|---|---|---|---|
| 5,153,826 | A | 10/1992 | Johnson | |
| 5,412,188 | A | 5/1995 | Metz | |
| 6,041,266 | A | 3/2000 | Nickerson | |
| 2002/0138163 | A1 | 9/2002 | MacPherson | |
| 2003/0204275 | A1 | 10/2003 | Krubeck | |
| 2005/0257216 | A1* | 11/2005 | Cornell | G06F 8/656 717/177 |
| 2008/0086223 | A1* | 4/2008 | Pagliarulo | A63B 24/0021 235/375 |
| 2010/0256789 | A1* | 10/2010 | Miller | G06Q 10/10 700/91 |
| 2014/0003652 | A1* | 1/2014 | Fedorovskaya | G06F 16/20 382/103 |

* cited by examiner

*Primary Examiner* — Jeffrey K Wong
(74) *Attorney, Agent, or Firm* — Brennan, Manna & Diamond, LLC

(57) ABSTRACT

A system for real-time rating and rankings of baseball players, which includes a server, one or more databases, and a ranking processing engine with a machine learning module. The system is accessible via a network by a plurality of clients, each of which includes a software application for displaying the ratings and statistics of baseball players. The system uses a plurality of performance parameters and a plurality of weighting factors for weighting the performance parameters. A machine learning algorithm is used for supervising the weighting factors for creating ratings of baseball players. The system provides the rankings to the clients via the software application, enabling fans, baseball organizations, media outlets, and other interested parties to track the performance of players in a more accurate and comprehensive manner. The system will create a unified world baseball ranking and assist in predicting the outcome of an individual or team match up.

18 Claims, 5 Drawing Sheets

BASEBALL PLAYERS' RATING SYSTEM

CROSS-REFERENCE TO RELATED APPLICATION

The present application claims priority to, and the benefit of, U.S. Provisional Application No. 63/341,146, which was filed on May 12, 2022, and is incorporated herein by reference in its entirety.

FIELD OF THE INVENTION

The present invention relates generally to the field of players' rating systems. More specifically, the present invention relates to a novel baseball players' rating system designed to provide ratings of baseball players using a plurality of performance parameters and weighting factors. The system eliminates the effect of personal opinions and enables selection of the No. 1 baseball player in the world by pure statistics. Further, the system can be used to assist in predicting the outcome of an individual or team match up. Finally, the system will create a unified world base ranking. Accordingly, the present disclosure makes specific reference thereto. Nonetheless, it is to be appreciated that aspects of the present invention are also equally applicable to other like applications, devices, and methods of manufacture.

BACKGROUND

By way of background, Baseball is a very popular sport throughout the world and specially in the United States. In fact, Baseball has been played for over a century. It is considered to be one of the oldest and most traditional sports and has a large and dedicated fan base, with millions of individuals attending games and watching broadcasts every year. In professional baseball, rating and rankings of baseball players are crucial for both teams and fans. Traditionally, awards, selection of players in teams, draft choices, and more, have been based on the opinions of sports analysts, coaches, and fans rather than solely on objective numerical values.

While statistics are a crucial part of evaluating player performance, they have their limitations. Baseball statistics do not differentiate between the strength of the opponent faced, which can significantly impact the player's performance. For example, a player who performs well against weaker teams may have better overall stats than a player who plays against stronger teams but performs slightly worse. Similarly, statistics cannot account for the different stages of the season, such as the beginning, middle, and end, which can affect a player's performance.

Geography is another crucial factor that can impact player performance, and it is not always accounted for in statistics. Players who play in different regions or at higher elevations may face different weather conditions, which can impact their performance. Additionally, players who play in more hitter-friendly ballparks may have inflated statistics compared to players who play in more pitcher-friendly parks.

Overall, determining the No. 1 player in the world in professional baseball using pure statistics can be challenging. There are numerous factors to consider beyond the player's numerical performance, including the quality of their opponents, the stage of the baseball season, and the geography of the games played. Therefore, there is a need for a ranking system that can take into account all of these factors to make a more objective determination of player performance. Therefore, there exists a long felt need in the art for an improved baseball players' ranking system. There is also a long felt need in the art for a baseball players' ranking system that includes additional parameters for rating and ranking baseball players. Additionally, there is a long felt need in the art for baseball players' rating system that enhances use of statistics for a more objective and correct ranking of baseball players. Moreover, there is a long felt need in the art for a baseball players' ranking system that uses body of work, results for performance, various game situations, geographical location, and more for rating players. Further, there is a long felt need in the art for players' rating system that enables individuals to identify the best player. Finally, there is a long felt need in the art for a baseball players' rating system that reduces the effect of a personal opinion on the No. 1 baseball player in the world and improves the use of statistics to make an objective determination.

The subject matter disclosed and claimed herein, in one embodiment thereof, comprises a computer implemented method for determining an objective rating for a baseball player based on the player's performance data and weighting factors. The method comprising the steps of receiving performance data of a player, calculating a plurality of performance parameters including at least a batting average, an on-base percentage, a slugging percentage, an on-base plus slugging, a fielding independent pitching, wins above replacement, and earned run average, including dynamically generating weighting factors for each performance parameter, wherein the weighting factors include at least work of a player, results for performance of a player, player's performance in different game situations and geographical locations, normalizing each performance parameter, and calculating an overall rating for each player using a machine learning model utilizing the weighting factors and normalized performance parameters. The ratings are used for determining the best player, ranking players, and are displayed on an application installed in client devices.

In this manner, the players' rating method of the present invention accomplishes all of the forgoing objectives and provides users with a method for determining worldwide professional baseball player rankings and rating levels. The method includes additional factors such as body of work, results for performance, various game situations, geographical location, and more, thus determining the No. 1 baseball player in the world by using pure statistics.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a method for determining a baseball player rating for a baseball player based on the player's performance data. The method comprising the steps of receiving performance data of a player, calculating a plurality of performance parameters including at least a batting average, an on-base percentage, a slugging percentage, an on-base plus slugging, a fielding independent pitching, wins above replacement, and earned run average, including dynamically generating weighting factors for each performance parameter based on at least a work of a player, results for performance of a player, player's performance in different game situations and geographical location, normalizing each performance parameter using an average of the particular parameter across all or some of the baseball players, and calculating an overall rating for each player using a machine learning model utilizing the weighting factors and normalized performance parameters.

In yet another embodiment, the weighting factors are dynamic and vary among players and can also vary for the same player with the course of time, based on the types of fields on which a specific player plays games/matches.

In yet another embodiment, the machine learning algorithm adjusts the weights based on historical player performance data and is periodically updated to incorporate new performance trends.

In yet another embodiment, a baseball player ranking system is disclosed. The system comprising a plurality of clients configured to access a server via a network, each of the clients including a software application for displaying ratings and other statistics of baseball players, the server comprising a processing unit, one or more databases for storing a plurality of information including baseball player personal information and playing information, the information received from a plurality of third-party sources including baseball organizations, fan communities, media outlets and more, the one or more databases coupled to the processing unit for storing the plurality of information, a ranking processing engine configured for generating real-time rating and rankings of baseball players, the ranking processing engine including a machine learning module configured to apply a plurality of supervised weighting factors to generate the real-time ratings, and a rating database for storing the real-time ratings and rankings of the players and providing the rankings to the clients via the software application.

In yet another embodiment, the overall rating of a player is calculated using the formula $f(w1x1+w2x2+\ldots+wn*xn)$, wherein x1, x2, . . . , xn are the normalized scores for performance parameters and w1, w2, . . . , wn are the corresponding adjusted weights assigned by the K-vector based on the weighting factors.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
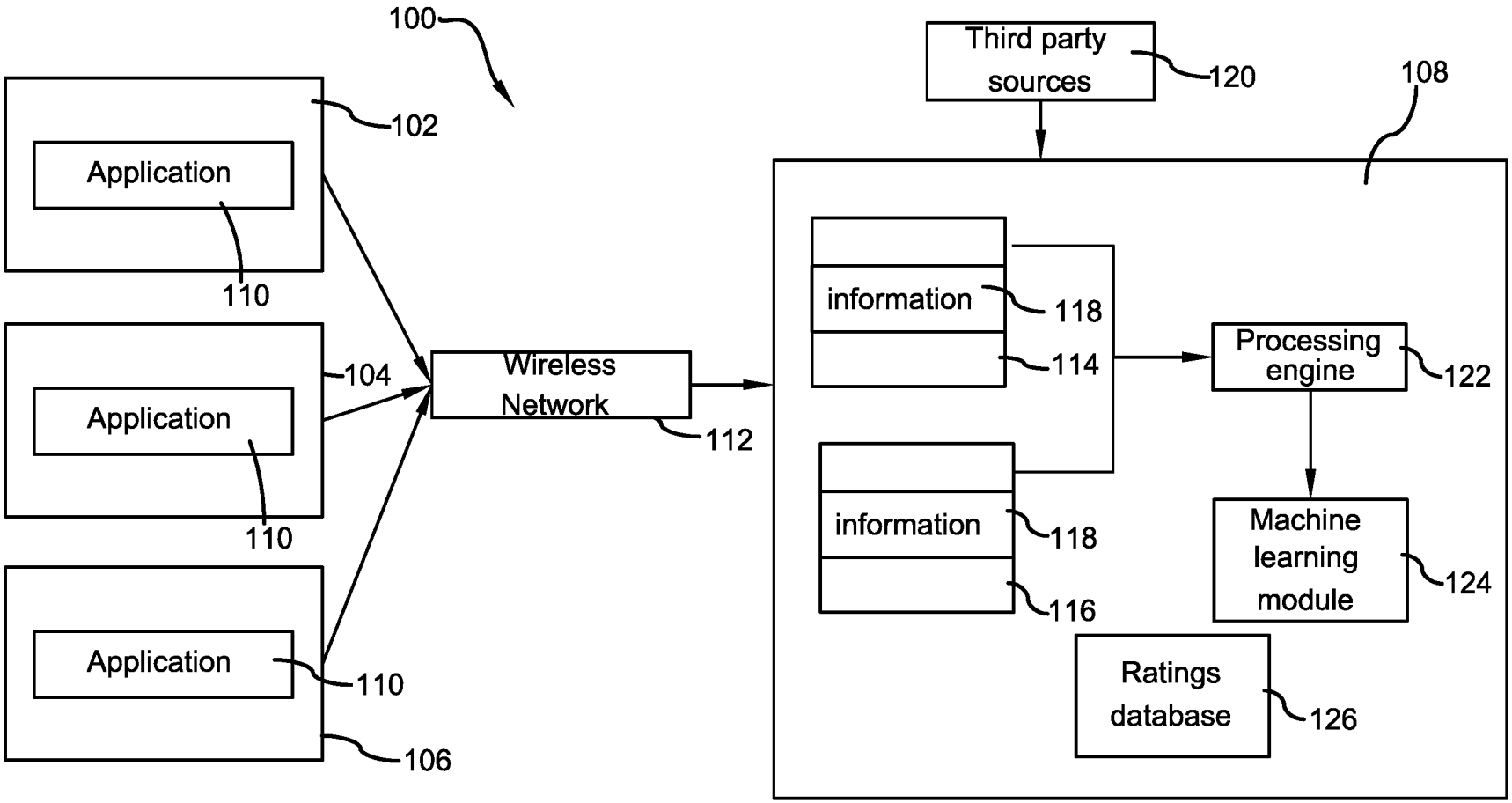
FIG. 1 illustrates a client and server system for providing rankings and rating levels of baseball players in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for an improved baseball players' ranking system. There is also a long felt need in the art for a baseball players' ranking system that includes additional parameters for rating and ranking baseball players. Additionally, there is a long felt need in the art for baseball players' rating system that enhances use of statistics for a more objective and correct ranking of baseball players. Moreover, there is a long felt need in the art for a baseball players' ranking system that uses body of work, results for performance, various game situations, geographical location, and more for rating players. Further, there is a long felt need in the art for players' rating system that enables individuals to identify the best player. Finally, there is a long felt need in the art for a baseball players' rating system that reduces the effect of a personal opinion on the No. 1 baseball player in the world and improves the use of statistics to make an objective determination.

The present invention, in one exemplary embodiment, is a baseball player ranking system. The system includes a plurality of clients, each of the clients including a software application for displaying ratings and other statistics of baseball players, a server, one or more databases for storing a plurality of information, the information received from a plurality of third-party sources, the one or more databases for storing the plurality of information, a ranking processing engine configured for generating real-time rating and rankings of baseball players, the ranking processing engine including a machine learning module configured to apply a plurality of supervised weighting factors to generate the real-time ratings, and a rating database for storing the real-time ratings and rankings of the players and providing the rankings to the clients via the software application.

Referring initially to the drawings, FIG. 1 illustrates a client and server system for providing rankings and rating levels of baseball players in accordance with the disclosed architecture. The baseball players' ranking system 100 is designed to determine worldwide professional baseball players (or potential professional baseball players) rankings and rating levels using a plurality of statistics, or a plurality of performance parameters, that reduces the effect of a personal opinion on the No. 1 baseball player in the world, thus, improving the use of statistics to make an objective determination. Generally, in the ranking system 100, a plurality of clients 102, 104, 106 access a server 108. The server 108 and clients 102, 104, 106 of the present invention can include any one of various types of computer devices, having, e.g., a processing unit, a memory, and a communication interface, as well as other conventional computer components (e.g., input device, such as a keyboard and mouse, output device, such as display). For example, the client 106 can include a desktop computer, laptop computer, mobile device such as a mobile phone, web-enabled phone, smart phone, and the like.

Each client of the clients 102, 104, 106 includes a software application 110 for displaying rankings and other statistics of baseball players. The software application 110 can be designed to be installed in different types of clients and different types of operating systems. The software application 110 allows users to access the functionalities offered by the server 108. The clients 102, 104, 106 can communicate with the server 108 using suitable communication interfaces via a network 112, such as the Internet. The clients 102, 104, 106 and the server 108 can communicate, in part or in whole, via wireless or hardwired communications, such as Ethernet, IEEE 802.11x wireless, Zigbee, or the like.

The server 108 can utilize various Web data interface techniques such as the Common Gateway Interface (CGI) protocol and associated applications (or "scripts"), Java™ "servlets", i.e., Java™ applications running on the Web server, or the like to present information and receive input from the clients 102, 104, 106 via the application 110. The server 108 is coupled to one or more databases 114, 116 for storing a plurality of information 118 including but not limited to baseball player's personal information, result of performance, geography locations, strength of schedule and more. The stored information 118 is received from a plurality of third-party sources 120 including baseball organizations, fans communities, media outlets and more.

The databases 114, 116 are coupled to a ranking processing engine 122 configured for receiving the stored information 118 and processing to generate real time rankings for the players. The ranking processing engine 122 includes a machine learning module 124 for applying a plurality of supervised weighting factors for generating rankings for the players as described later in the disclosure. A ranking database 126 stores the real time rankings of the players and are provided to the users on the application 110.

Figure 2:
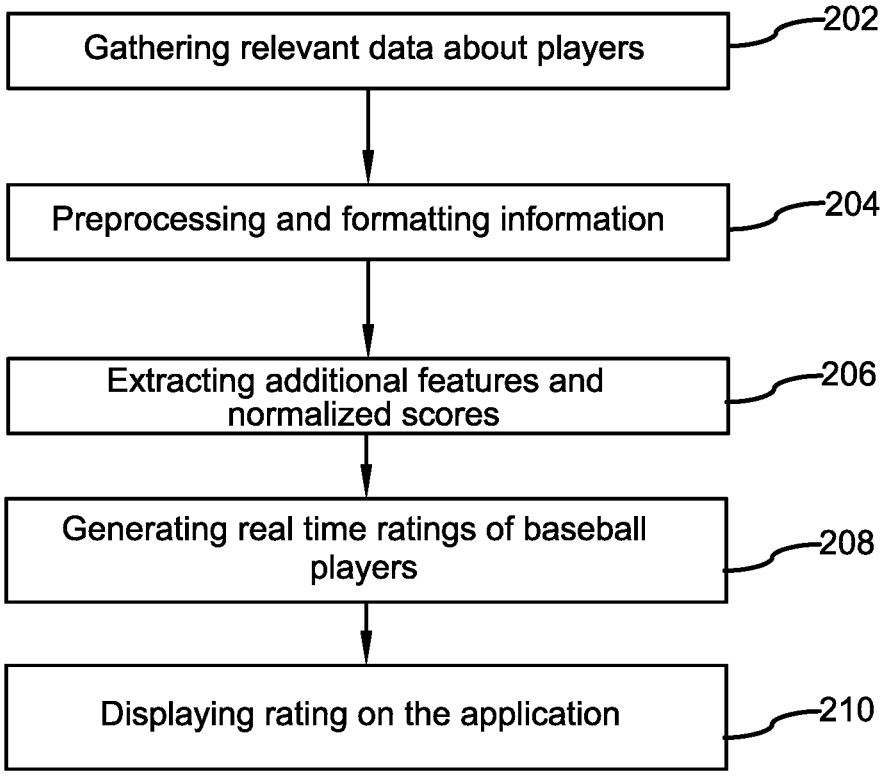
FIG. 2 illustrates a flow chart depicting a process of generating a baseball player's ranking by the baseball players' ranking system of the present invention in accordance with the disclosed architecture.

FIG. 2 illustrates a flow chart depicting a process of generating baseball players ranking by the baseball players' ranking system 100 of the present invention in accordance with the disclosed architecture. Initially, relevant data about the players is gathered from the third-party sources (Step 202). The information can include player's physical attributes, past injuries, performance in different game situations, and more. Then, the information is preprocessed and formatted in an appropriate format for storage in the databases 114, 116 (Step 204). This process can include removing irrelevant or incomplete data, encoding data into different categories, and normalizing numerical data for storage and processing by machine learning module 124.

Figure 4:
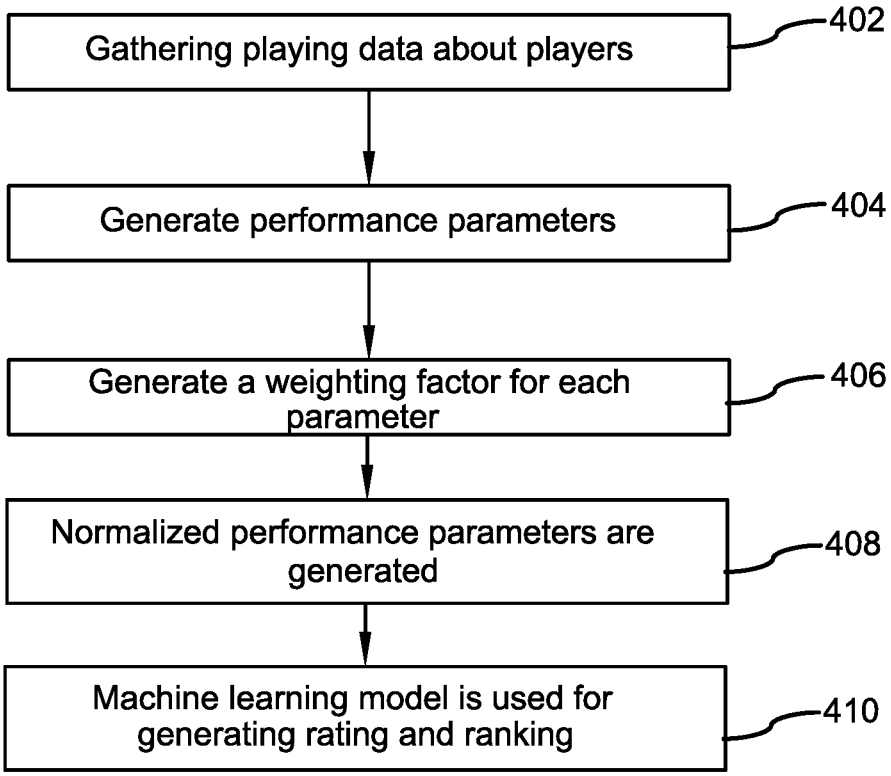
FIG. 4 illustrates a flow diagram illustrating various steps of a method of determining at least one baseball player rating according to one embodiment of the present invention.

Thereafter, in the next step 206, additional features including statistics as illustrated in FIG. 4 and Tables 1-3, from the stored information are calculated for machine learning module 124. The additional features can include a player's batting average or earned run average based on their past performance, a player's geographical location to create a feature that reflects their home field advantage and more. The additional features can also be stored in the databases 114, 116. Then, the machine learning module 124 applies ranking parameters and algorithm for generating a rating of the players based on the stored information and statistics (Step 208). Finally, the rankings of the worldwide baseball players are broadcasted and displayed on the user interfaces provided by the application (Step 210).

The system 100 continuously updates the rankings of the players based on new data of the players as it becomes available in the databases 114, 116, such as the results of new games and updated player information. This helps ensuring that the rankings remain up-to-date and accurate over time.

Figure 3:
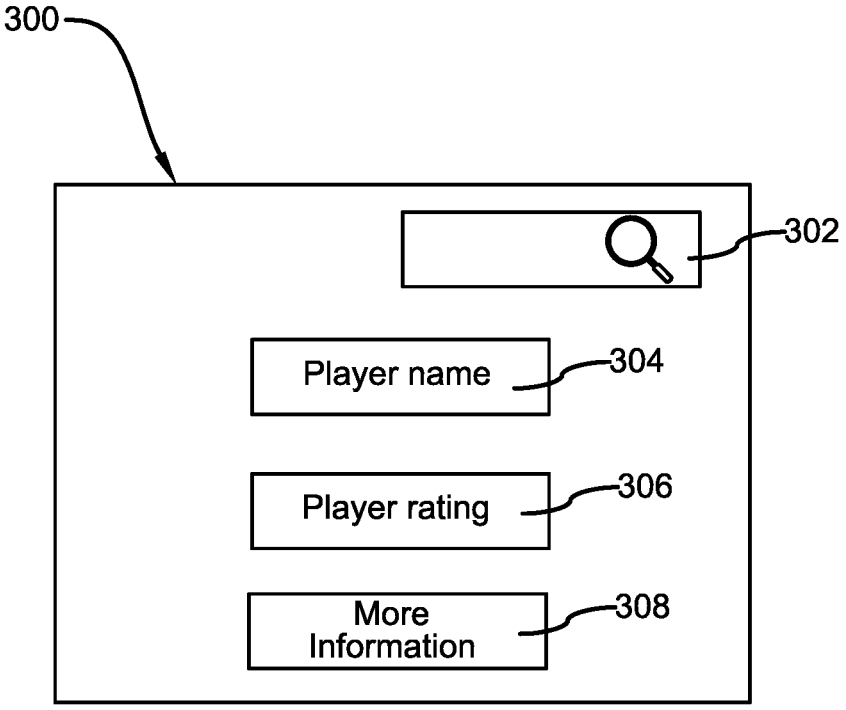
FIG. 3 illustrates an exemplary user interface displayed by an application for displaying the ranking of baseball players generated by the baseball players' ranking system of the present invention in accordance with the disclosed architecture.

FIG. 3 illustrates an exemplary user interface displayed by the application 110 for displaying the ranking of baseball players generated by the baseball players' ranking system 100 of the present invention in accordance with the disclosed architecture. The user interface 300 displays a search bar 302 for enabling a user to search for a specific player in the application 110. The search bar 302 can take any combination of alphabets as an input for displaying the search results. The user interface 300 is also configured to display Name of the player 304 along with ranking 306, wherein the ranking 306 is a real-time ranking generated by the system 100.

More information such as batting average, wins above replacement, on-base percentage, earned run average and more are displayed using the "More Information" tab 308. It should be noted that the user interface 300 can display information for a plurality of baseball players simultaneously.

FIG. 4 illustrates a flow diagram illustrating various steps of a method of determining at least one baseball player rating according to one embodiment of the present invention. Initially, performance data of a player is received by the system (Step 402). The data can include number of hits, number of at-bats, number of walks, number of hit-by-pitches, number of bases, home runs, strikeouts, batting runs, running runs, fielding runs, replacement runs, and more. Then, a plurality of different performance parameters as illustrated in Table 1 are calculated by the system 100 that are used for generation of the ranking of the players (Step 404).

TABLE 1

| Performance Parameters | Calculation formula |
|---|---|
| Batting Average (AVG) | (Total hits/total at-bats) |
| On-base Percentage (OBP) | (Hits + Walks + Hit by Pitch)/(At Bats + Walks + Hit by Pitch + Sacrifice Flies) |
| Slugging Percentage (SLG) | (Total Bases/At Bats) |
| On-base plus Slugging (OPS) | OBP + SLG |
| Fielding Independent Pitching (FIP) | (13 * total home runs allowed + 3 * (total walks + total hit-by-pitches) − 2 * total strikeouts)/total innings pitched + league FIP constant |
| Wins Above Replacement (WAR) | (Batting runs + Base Running runs + Fielding runs + Positional adjustment + League adjustment + Replacement runs)/(Runs per win) |
| Earned Run Average (ERA) | (Total earned runs/total innings pitched) * league ERA constant |

Based on at least body of work of a player, results for performance of a player, player's performance in different game situations and geographical location of the fields/stadiums, a weighting factor is dynamically generated for each performance parameter (Step 406). Body of work refers to a player's overall performance over a longer period of time, such as a season or multiple seasons. The parameter takes into account the player's consistency and durability, as well as their ability to perform well against a variety of opponents and in different situations. Results of performance refers to a player's performance in individual games or events. It can include factors such as the player's statistical performance, their impact on the outcome of the game, and their ability to perform under pressure (e.g. hitting in clutch situations).

Game situation refers to the specific circumstances of each game or event, such as the score, inning, outs, and baserunner situations. It considers how well the player performs in different situations, such as hitting with runners in scoring position or pitching in high-pressure situations. Geographical location refers to the location of the game or event, such as whether it was played at home or on the road, in a hitter-friendly or pitcher-friendly ballpark, or in a region with different weather or climate conditions. It takes into account how well the player performs in different environments, and whether their performance is affected by external or environmental factors such as altitude or humidity.

The weighting factors are dynamic in nature and can vary among the players and can also vary for the same player and over the course of time. Table 2 provides exemplary weighting or scaling factors provided to the performance parameters in accordance with one embodiment of the present invention.

TABLE 2

| Performance Parameters | Weighting factors |
|---|---|
| Batting Average (AVG) | (0.4 * Body of Work) + (0.3 * Results for Performance) + (0.2 * Various Game Situations) + (0.1 * Geographical Location) |
| On-base Percentage (OBP) | (0.3 * Body of Work) + (0.4 * Results for Performance) + (0.2 * Various Game Situations) + (0.1 * Geographical Location) |
| Slugging Percentage (SLG) | (0.3 * Body of Work) + (0.3 * Results for Performance) + (0.3 * Various Game Situations) + (0.1 * Geographical Location) |
| On-base plus Slugging (OPS) | (0.25 * Body of Work) + (0.35 * Results for Performance) + (0.3 * Various Game Situations) + (0.1 * Geographical Location) |
| Fielding Independent Pitching (FIP) | (0.2 * Body of Work) + (0.3 * Results for Performance) + (0.35 * Various Game Situations) + (0.15 * Geographical Location) |
| Wins Above Replacement (WAR) | (0.2 * Body of Work) + (0.4 * Results for Performance) + (0.2 * Various Game Situations) + (0.2 * Geographical Location) |
| Earned Run Average (ERA) | (0.4 * Body of Work) + (0.2 * Results for Performance) + (0.3 * Various Game Situations) + (0.1 * Geographical Location) |

Then, in the next step, each parameter score is normalized using an average of the particular parameter across all or some of the baseball players (Step 408). It should be noted that Step 406 and Step 408 can be interchanged during the execution for generating a normalized score for each player. For normalization, below table shows the formula used.

TABLE 3

| Performance Parameters | Normalization |
|---|---|
| Batting Average (AVG) | (player AVG/total players AVG) |
| On-base Percentage (OBP) | (player OBP/total players OBP) |
| Slugging Percentage (SLG) | (player SLG/total players SLG) |
| On-base plus Slugging (OPS) | (player OPS/total players OPS) |
| Fielding Independent Pitching (FIP) | (player FIP/total players FIP) |
| Wins Above Replacement (WAR) | (player WAR/total players WAR) |
| Earned Run Average (ERA) | (player ERA/total players ERA) |

Then, a K-vector or any other similar machine learning model is used for calculating a player's overall rating and ranking (Step 410). Overall rating is calculated using the formula:

Overall rating: $f(w1x1+w2x2+ \ldots +wn*xn)$;

x1, x2, . . . , xn are the normalized scores for performance parameters;

w1, w2, . . . , wn are the corresponding adjusted weights assigned by the K-vector based on the weighting factors of Table 2;

The "f" is a function that maps the weighted sum of parameter scores to an overall rating on a predetermined scale, such as 0 to 100 or 0 to 1. The K-vector learns the optimal values for adjusting the weights based on historical player performance data and would be updated periodically to incorporate new performance trends.

Figure 5:
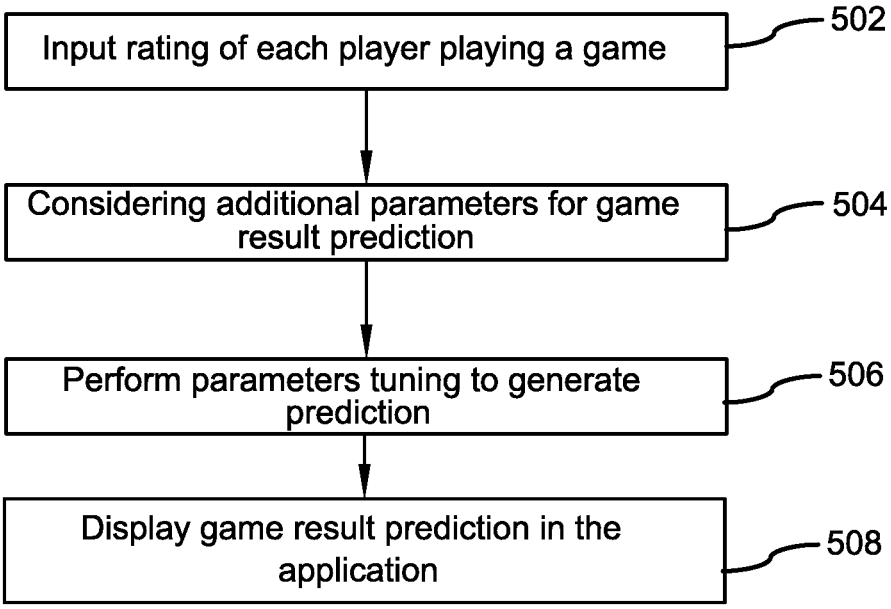
FIG. 5 illustrates a flow diagram illustrating a process of predicting game results based on the rating of players by the system of the present invention in accordance with the disclosed architecture.

FIG. 5 illustrates a flow diagram illustrating a process of predicting game results based on the rating of players by the system 100 of the present invention in accordance with the disclosed architecture. Initially, the rating of each of the player participating in a baseball game is taken as an input in the machine learning module of the system (Step 502). Then, other parameters such as field/stadium/ballpark location, field size, altitude of the field/stadium/ballpark and more are considered for parameter tuning for prediction of the game result (Step 504). For example, the players playing in their home field/stadium/ballpark can be given more weightage for influencing the prediction of the game result. During parameters tuning by the machine learning module, the number of layers in a neural network or the number of trees in a random forest are updated to optimize the performance data of the players for predicting the game result (Step 506). Finally, the game result prediction is broadcasted and displayed in the software application 110 (Step 508).

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "baseball players' ranking system", "ranking system", and "system" are interchangeable and refer to the world baseball rating system 100 of the present invention.

In this regard, FIGS. 1-5 are block diagrams and flowchart illustrations of methods, systems and program products according to the invention. It will be understood that each block or step of the block diagram, flowchart and control flow illustrations, and combinations of blocks in the block diagram, flowchart, and control flow illustrations, can be implemented by computer program instructions. These computer program instructions may be loaded onto a computer or other programmable apparatus to produce a machine, such that the instructions that execute on the computer or other programmable apparatus create means for implementing the functions specified in the block diagram, flowchart or control flow block(s) or step(s). These computer program instructions may also be stored in a computer-readable memory that can direct a computer or other programmable apparatus to function in a particular manner, such that the instructions stored in the computer-readable memory produce an article of manufacture including instruction means which implement the function specified in the block diagram, flowchart or control flow block(s) or step(s). The computer program instructions may also be loaded onto a computer or other programmable apparatus to cause a series of operational steps to be performed on the computer or other programmable apparatus to produce a computer implemented process such that the instructions which execute on the computer or other programmable apparatus provide steps for implementing the functions specified in the block diagram, flowchart or control flow block(s) or step(s).

Notwithstanding the forgoing, the world baseball rating system 100 of the present invention can be of any suitable configuration as is known in the art without affecting the overall concept of the invention, provided that it accomplishes the above stated objectives. One of ordinary skill in the art will appreciate that the world baseball rating system 100 as shown in the FIGS. are for illustrative purposes only, and that many other configuration and design of the world baseball rating system 100 are well within the scope of the present disclosure.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A baseball players' ratings system to predict the outcome of a team match up comprising:

a computer device, wherein said computer device having a processing unit, a memory, a communication interface, an input device, an output device, and a display;

an application having a plurality of performance parameters for compiling a baseball players' ratings;

a plurality of weighting factors for weighting said plurality of performance parameters;

a ranking database coupled to a ranking processing engine configured for receiving and storing said plurality of performance parameters and said baseball players' ratings;

wherein said plurality of performance parameters comprise a Batting Average (AVG), On-base Percentage (OBP), Slugging Percentage (SLG), On-base plus Slugging (OPS), Fielding Independent Pitching (FIP), Wins Above Replacement (WAR), and Earned Run Average (ERA); and wherein said plurality of weighting factors comprise a body of work, a results for performance, a game situation, and a geographical location;

wherein said baseball players' ratings based on the plurality of performance parameters and the plurality of weighting factors are generated by the ranking processing engine in real-time;

wherein said display displays said plurality of performance parameters and said baseball players' ratings; and wherein said ranking database stores real time said baseball players' ratings and are provided to the users on said application to predict the outcome of a team match up comprising ranking opposing players using their respective said baseball players' ratings.

2. The baseball players' ratings system to predict the outcome of a team match up of claim 1, wherein at least two of said plurality of weighting factors are applied to each of said plurality of performance parameters.

3. The baseball players' ratings system to predict the outcome of a team match up of claim 1, wherein at least three of said plurality of weighting factors are applied to each of said plurality of performance parameters.

4. The baseball players' ratings system to predict the outcome of a team match up of claim 1, wherein at least four of said plurality of weighting factors are applied to each of said plurality of performance parameters.

5. The baseball players' ratings system to predict the outcome of a team match up of claim 1, wherein each of said plurality of performance parameters is normalized using an average of each respective said plurality of performance parameters divided by an average of a multitude of other players' respective said plurality of performance parameters.

6. The baseball players' ratings system to predict the outcome of a team match up of claim 5, wherein said game situation is a specific circumstance of each game selected from a group consisting of a score, an inning, a number of outs, and a baserunner situation.

7. The baseball players' ratings system to predict the outcome of a team match up of claim 6, wherein said plurality of performance parameters further having a player's physical attributes and past injuries.

8. The baseball players' ratings system to predict the outcome of a team match up of claim 7, wherein said geographical location is an environmental factor selected from a group consisting of a geographic location of a game, a home game, an away game, a hitter-friendly ballpark, a pitcher-friendly ballpark, a climate condition, an altitude, and a humidity level.

9. The baseball players' ratings system to predict the outcome of a team match up of claim 8, wherein said plurality of performance parameters are further selected from a group consisting of a number of hits, a number of at-bats, a number of walks, a number of hit-by-pitches, a number of bases, a number of home runs, a number of strikeouts, a number of batting runs, a number of running runs, a number of fielding runs, and a number of replacement runs.

10. A baseball players' ratings system to predict the outcome of a team match up comprising:

a computer device;

an application having a plurality of performance parameters for compiling baseball players' ratings;

a plurality of weighting factors for weighting said plurality of performance parameters, wherein said computer device having a processing unit, a memory, a communication interface, an input device, an output device, and a display;

a ranking database coupled to a ranking processing engine configured for receiving and storing said plurality of performance parameters and said baseball players' ratings;

wherein said plurality of performance parameters comprise a Batting Average (AVG), On-base Percentage (OBP), Slugging Percentage (SLG), On-base plus Slugging (OPS), Fielding Independent Pitching (FIP), Wins Above Replacement (WAR), and Earned Run Average (ERA);

wherein said plurality of weighting factors comprise a body of work, a results for performance, a game situation, and a geographical location;

wherein at least two of said plurality of weighting factors are applied to each of said plurality of performance parameters;

wherein each of said plurality of performance parameters is normalized using an average of each respective said plurality of performance parameters of a baseball player divided by an average of a multitude of other players' respective said plurality of performance parameters; and wherein said baseball players' ratings based on the plurality of performance parameters and the plurality of weighting factors is generated by the ranking processing engine in real-time;

wherein said display displays said plurality of performance parameters and said baseball players' ratings; and wherein said ranking database stores real time said baseball players' ratings and are provided to the users on said application to predict the outcome of a team match up comprising ranking opposing players using their respective said baseball players' ratings.

11. The baseball players' ratings system to predict the outcome of a team match up of claim 10, wherein at least four of said plurality of weighting factors are applied to each of said plurality of performance parameters.

12. The baseball players' ratings system to predict the outcome of a team match up of claim 11, wherein said game situation is a specific circumstance of each game selected from a group consisting of a score, an inning, a number of outs, and a baserunner situation.

13. The baseball players' ratings system to predict the outcome of a team match up of claim 12, wherein said plurality of performance parameters further having a player's physical attributes and past injuries.

14. The baseball players' ratings system to predict the outcome of a team match up of claim 13, wherein said geographical location is an environmental factor selected from a group consisting of a geographic location of a game, a home game, an away game, a hitter-friendly ballpark, a pitcher-friendly ballpark, a climate condition, an altitude, and a humidity level.

15. The baseball players' ratings system to predict the outcome of a team match up of claim 14, wherein said plurality of performance parameters are further selected from a group consisting of a number of hits, a number of at-bats, a number of walks, a number of hit-by-pitches, a number of bases, a number of home runs, a number of strikeouts, a number of batting runs, a number of running runs, a number of fielding runs, and a number of replacement runs.

16. A method of rating baseball players to predict the outcome of a team match up, the method comprising the steps of:

providing a computer device and an application having a plurality of performance parameters for compiling a baseball players' ratings, wherein said computer device having a processing unit, a memory, a communication interface, an input device, an output device, and a display;

receiving and storing said plurality of performance parameters and said baseball players' ratings in a ranking database coupled to a ranking processing engine, wherein said plurality of performance parameters comprise a Batting Average (AVG), On-base Percentage (OBP), Slugging Percentage (SLG), On-base plus Slugging (OPS), Fielding Independent Pitching (FIP), Wins Above Replacement (WAR), and Earned Run Average (ERA);

weighting said plurality of performance parameters with a plurality of weighting factors, wherein said plurality of weighting factors comprise a body of work, a results for performance, a game situation, and a geographical location;

applying at least two of said plurality of weighting factors to each of said plurality of performance parameters, wherein a weight of said body of work is from 0.20 to 0.40, a weight of said results for performance is from 0.20 to 0.40, a weight of said game situation is from 0.20 to 0.35, and a weight of said geographical location is from 0.10 to 0.20;

generating said baseball players' ratings based on the plurality of performance parameters and the plurality of weighting factors in real-time;

wherein said display displays said plurality of performance parameters and said baseball players' ratings; and wherein said ranking database stores real time said baseball players' ratings and are provided to the users on said application to predict the outcome of a team match up comprising ranking opposing players using their respective said baseball players' ratings.

17. The method of rating baseball players to predict the outcome of a team match up of claim 16 further comprising a step of normalizing each of said plurality of performance parameters using an average of each respective said plurality of performance parameters of the baseball player divided by an average of a multitude of other players' respective said plurality of performance parameters.

18. The method of rating baseball players to predict the outcome of a team match up of claim 17 further comprising a step of applying at least three of said plurality of weighting factors to each of said plurality of performance parameters.

* * * * *